US005490654A

United States Patent [19]

Herriman

[11] Patent Number: 5,490,654

[45] Date of Patent: Feb. 13, 1996

[54] ADJUSTABLE MOUNTING APPARATUS FOR A TELESCOPE

[76] Inventor: William P. Herriman, 707 Cardinal, Kerville, Tex. 78028

[21] Appl. No.: 111,610

[22] Filed: Aug. 25, 1993

[51] Int. Cl.[6] ..... F41G 11/00

[52] U.S. Cl. ..... 248/316.1; 248/309.1; 33/248

[58] Field of Search ..... 248/316.1, 316.8, 248/309.1, 313, 176, 689, 527, 231.7, 231.8; 33/248, 250, 247, 245; D22/109, 110; 42/100, 101

[56] References Cited

U.S. PATENT DOCUMENTS

| | | | |
|---|---|---|---|
| D. 331,442 | 12/1992 | Bechtel | D22/110 |
| 638,007 | 11/1899 | Darling | 33/247 |
| 2,629,176 | 2/1953 | Ivy | 33/248 |
| 2,645,855 | 7/1953 | Ivy | 33/248 |
| 2,857,675 | 10/1958 | Kesselring | 248/316.1 X |
| 3,040,433 | 6/1962 | Heinzel | 33/248 |
| 3,177,587 | 4/1965 | Hart | 33/248 |
| 3,374,544 | 3/1968 | Pitchford | 33/247 |
| 4,501,071 | 2/1985 | Manske | 33/250 X |

FOREIGN PATENT DOCUMENTS

| | | | |
|---|---|---|---|
| 589618 | 12/1959 | Canada | 248/74.3 |

*Primary Examiner*—Karen J. Chotkowski
*Attorney, Agent, or Firm*—Kenneth D. Baugh

[57] ABSTRACT

An adjustable mounting apparatus 10 is provided for supporting and holding a telescope 12 in a predetermined position. The mounting apparatus 10 includes a base support member 14 in which the telescope 12 is placed. A first pair of adjustment screws 40 and 42 mounted in one side of the support member 14 are provided to engage adjacent side portions of the telescope 12 on one side of the support member, and a second pair of adjustment screws 40 and 42, mounted in the other side of the support member 14 are provided to engage adjacent side portions of the other side of the telescope. A first elastic band 48 is removably couplable to a first pair of post 44 for engaging an upper portion of telescope 12, and a second elastic band is removably couplable to a second pair of post 46 for engaging other upper portions of telescope 12. As a result the telescope 12 can be held in place in a predetermined stationary position.

10 Claims, 3 Drawing Sheets

ADJUSTABLE MOUNTING APPARATUS FOR A TELESCOPE

TECHNICAL FIELD

This invention relates to a telescope mounting apparatus and more particularly an adjust able mounting apparatus for supporting and holding a telescope in a stationary predetermined position. Telescopes are used in a variety of activities and occupations such as astronomy, hunting and even bird watching. Because of the many uses for the telescope, there are many styles and sizes of telescopes on the market today. One persons individual activities may vary so much that that person may own one or more telescopes of various styles and sizes. One of the key components to the telescope is the mounting apparatus that secures it in a stationary position while in use. The mounting apparatus supports the telescope in a stationary position on devices such as, for example, tripods and rifles. Since the mounting apparatus is a necessary component, a user may have as many mounting apparatuses as the styles and sizes of telescope that are required for that users activities. Because of this there exists a need for a single adjustable mounting apparatus which can accommodate many styles and sizes of telescopes.

BACKGROUND ART

There are a number of different types of telescope mounts or bases in existence. One such device is disclosed in U.S. Pat. No. 4,562,658. This patent discloses an adjustable mount. The mount of this invention is a scope mount for a rifle and has mounting studs which are held in position by engagement of their lower conical faces with apertures in the mounting plate. A pair of clamps are secured to the mounting studs by adjustment screws which have conical end faces that engage the conical faces of the studs to draw the clamp down on the mounting plate.

Another such device is disclosed in U.S. Pat. No. 4,574,508 which discloses a telescope sight Mount. The telescope sight mount of this invention discloses a mount having a base portion and cap means flexibly connected together at a joint above the centerline of the sight mount connectable to the base portion. There is also a tightening means connecting the cap means to the base portion at a point below the centerline of the sight mount.

Although these devices are acceptable for the purposes for which they are designed, neither discloses an arrangement which can accommodate different styles and sizes of telescope.

DISCLOSURE OF THE INVENTION

An adjustable mounting apparatus for supporting and holding a telescope in a predetermined position is provided. The mounting apparatus includes a base support member. A first means for adjustably engaging adjacently aligned side portions of the telescope is coupled to one side of the support member. A second means for adjustably engaging other adjacently aligned side portions of the telescope is coupled to the other side of the support member. The mounting apparatus also includes a first coupling means for adjustably engaging adjacently aligning upper portions of the telescope, and a second coupling means, for adjustably engaging other adjacently aligned upper portions of the telescope. As a result, when the first and second coupling means are coupled to the telescope and the first and second engaging means are moved to engage the telescope, the telescope is locked in the predetermined position.

BEST MODE FOR CARRYING OUT THE INVENTION

Figure 1:
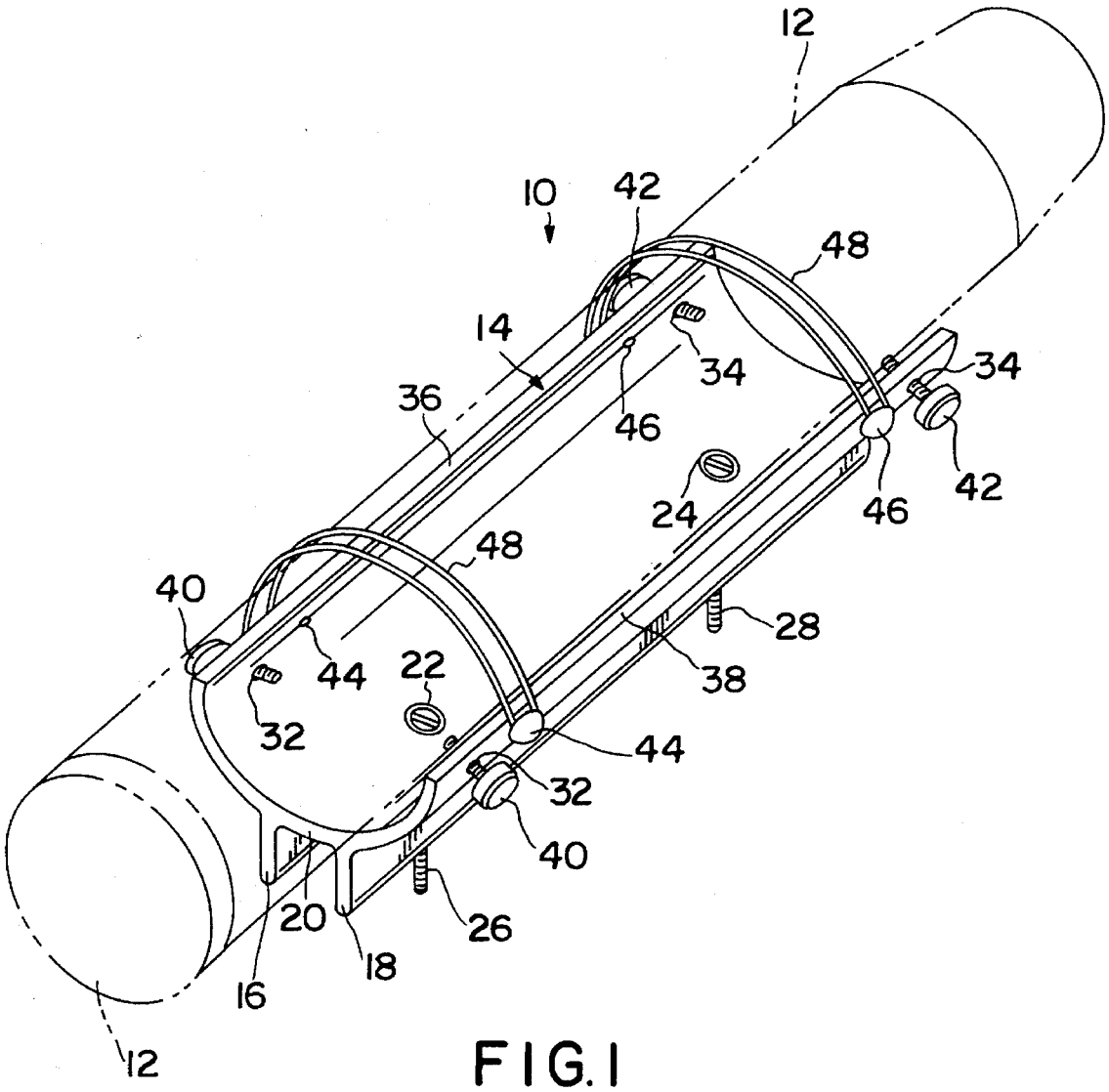
FIG. 1 is a perspective view of an adjustable mounting apparatus for supporting a telescope in accordance with the principles of the invention.
Figure 2:
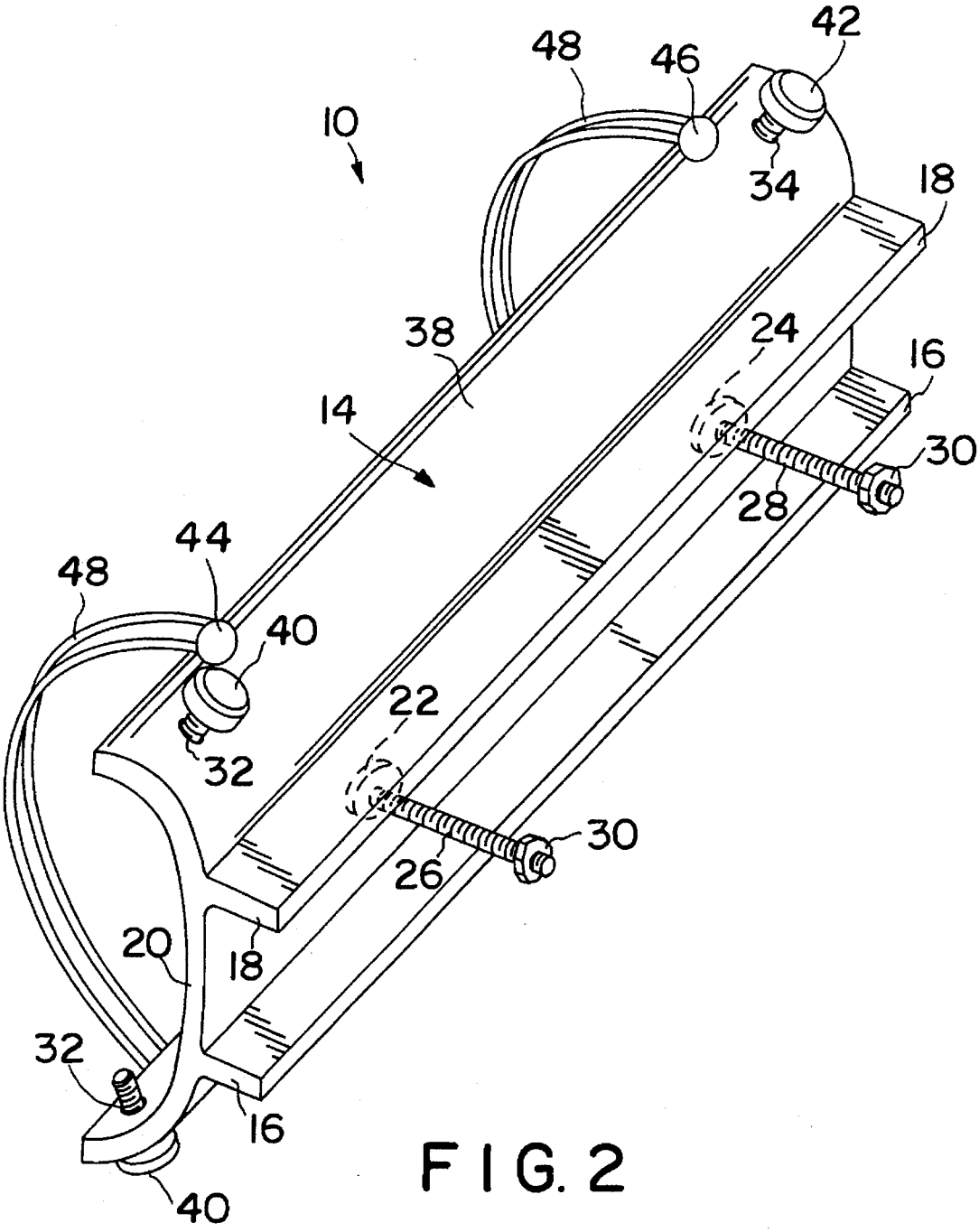
FIG. 2 is a bottom perspective view of the adjustable mounting apparatus in accordance with the principles of the invention.
Figure 3:
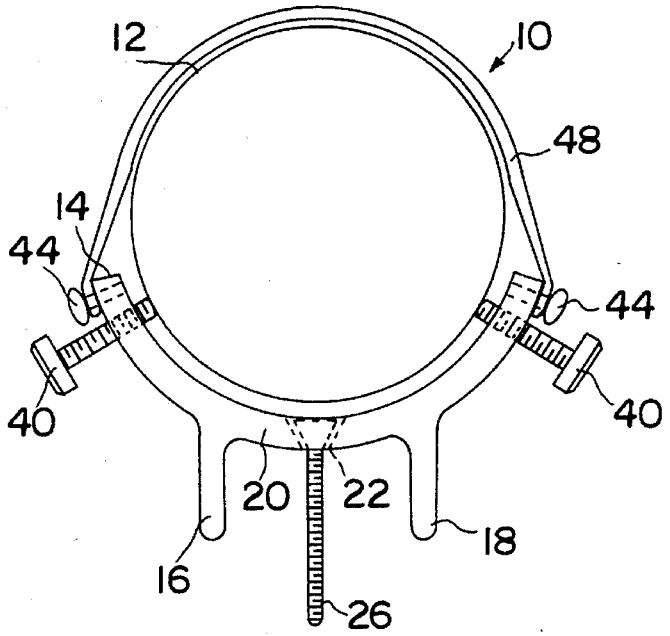
FIG. 3 is an end view of the adjustable mounting apparatus in accordance with the principles of the invention.
Figure 4:
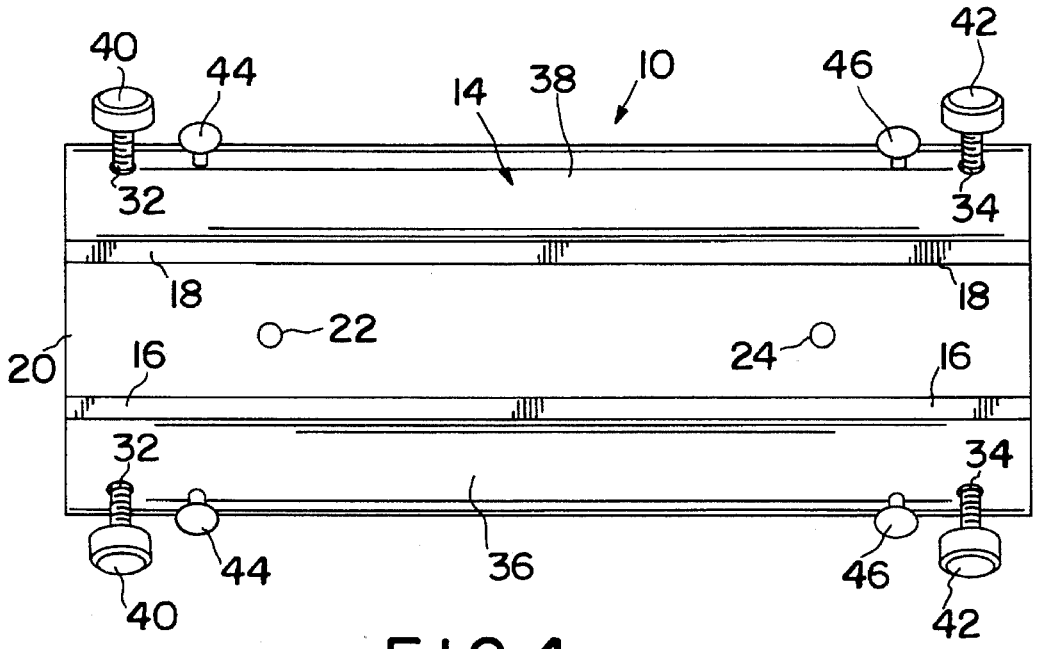
FIG. 4 is a bottom view of the adjustable mounting apparatus in accordance with the principles of the invention.

Referring to FIGS. 1, 2 and 3 an adjustable mounting device, generally designated, by the numeral 10 is provided for supporting and holding a telescope 12. The mounting apparatus 10 is provided with an elongated semi-cylindrically shaped base support member, generally designated, by the number 14. The elongated base support member 14 includes a pair of spaced elongated supporting legs 16 and 18 formed on a bottom portion 20 of the support member (FIG. 4). The elongated base support member 14 also includes two spaced mounting apertures 22 and 24 which are formed in the bottom portion 20 of the supporting member 14 between the legs 16 and 18 (FIG. 4). Mounting screws 26 and 28 are provided to extend into and through the apertures 22 and 24. Couplers 30 cooperate with the mounting screws 26 and 28 to hold the mounting apparatus and telescope 12 in place on another supporting device such as, for example, a tripod or a rifle (not shown).

The elongated base support member 14 also includes a pair of spaced threaded apertures 32 and 34 formed in each side 36 and 38 of the support member (FIG. 4). The apertures 32 and 34 are provided to receive adjustment screws 40 and 42. These screws 40 and 42 can be adjusted in or out to exert a force which lockingly engages adjacently aligned side portions of the telescope 12.

The adjustable mounting apparatus 10 is also provided with a pair of spaced aligned studs or posts 44 and 46 formed in each side 36 and 38 of the support member 14 (FIG. 4). Elastic bands or coupling members 48 are provided to be coupled to the posts 44 and 46 across an adjacently aligned upper portion of the telescope 12. The telescope 12 is further held in place in the base support member 14 by coupling the elastic bands 48 to the posts 44 and 46. The elastic bands exert a downward force on the adjacently aligned upper portions of the telescope 12 thereby lockingly engaging these upper portions of the telescope in the support member. With the adjustment screws 40 and 42 lockingly engaging adjacently aligned side portions of the telescope 12 and the elastic bands 48 engaging adjacently aligned upper portions of the telescope, this assures that the telescope is properly secured in a stationary position in the mounting apparatus 10.

Additionally, because the adjustment screws 40 and 42 can be screwed in or out and the bands 48 are elastic, many different styles and sizes of telescope can be secured in a stationary position by the mounting apparatus 10.

When it is desired to use the mounting apparatus 10 of this invention, the adjustment screws 40 and 42 are adjusted so that the telescope 12 can be placed inside the elongated base support member 14. Once this is done, adjustment screws 40 and 42 are adjusted depending on the style and size of the telescope 12 to engage adjacently aligned side portions of the telescope thereby applying pressure thereto to hold it in place in the base support member 14. Once the screws have been properly adjusted the elastic bands 48 are stretched across the telescope and attached to the posts 44 and 46 placing a downward force across adjacently aligned upper portions of the telescope further securing the telescope in place in the base support member to be held in a stationary position on the mounting apparatus 10. The mounting apparatus 10 can then be coupled to another supporting apparatus such as, for example, a tripod or a rifle by mounting screws 26 and 28 and couplers 30 if desired.

It should be understood that various changes and modifications can be made without departing from the spirit of the invention as defined in the claim.

What is claimed:

1. An adjustable mounting apparatus for supporting and holding a telescope in a predetermined position including:

an elongated semi-cylindrically shaped base support member;

a first engaging means coupled to one side of the elongated semi-cylindrically shaped base support member for adjustably locking engaging adjacently aligned side portions of the telescope;

a second engaging means coupled to the other side of the elongated semi-cylindrically shaped base support member for adjustably lockingly engaging other adjacently aligned side portions of the telescope;

a first coupling means for adjustably engaging adjacently aligned upper portions of the telescope; and a second coupling means for adjacently engaging other adjacently aligned upper portions of the telescope so that when the first and second coupling means are coupled to engage the telescope and the first and second engaging means are moved to lockingly engage the telescope, the telescope is locked in the predetermined position.

2. An adjustable mounting apparatus for supporting and holding a telescope in a predetermined position as defined in claim 1 wherein the first engaging means includes a pair of adjustment screws for lockingly engaging the telescope in the elongated semi-cylindrically shaped base support member.

3. An adjustable mounting apparatus for supporting and holding a telescope in a predetermined position as defined in claim 2 wherein the second engaging means is a pair of adjustment screws for lockingly engaging the telescope in the elongated semi-cylindrically shaped base support member.

4. An adjustable mounting apparatus for supporting and holding a telescope in a predetermined position as defined in claim 3 wherein the first coupling means is an elastic band.

5. An adjustable mounting apparatus for supporting and holding a telescope in a predetermined position defined in claim 4 wherein the second coupling means is an elastic band.

6. An adjustable mounting apparatus for supporting and holding a telescope in a predetermined position including:

an elongated semi-cylindrically shaped base support member having a first pair of spaced aligned apertures formed in one side thereof and a second pair of spaced aligned apertures formed in the other side of thereof;

a first pair of engaging members, each one of the first pair of engaging members being treadedly mounted for movement in one of the first pair of apertures to be selectively moved to lockingly engage adjacently aligned side portions of the telescope;

a second pair of engaging members, each one of the second pair of engaging members being treadedly mounted for movement in one of the second pair of apertures to be selectively moved to lockingly engage other adjacently aligned side portions of the telescope;

a first pair of spaced aligned posts formed in the one side of the elongated semi-cylindrically shaped base support member;

a second pair of spaced aligned posts formed in the other side of the elongated semi-cylindrically shaped base support member;

a first coupling member, having first portions thereof removably couplable to one post of the first pair of spaced aligned posts and second portions thereof removably couplable to one post of the second pair of post to allow third portions thereof to engage adjacently aligned upper portions of the telescope; and a second coupling member, having first portions thereof removably couplable to the other post of the first pair of spaced aligned posts and second portions thereof removably couplable to the other post of the second pair of post to allow third portions thereof to engage adjacently aligned upper portions of the telescope so that when the first and second coupling members are coupled to the posts and the first and second engaging members are moved to lockingly engage the telescope, the telescope is locked in the predetermined position.

7. An adjustable mounting apparatus for supporting and holding a telescope in a predetermined position as defined in claim 6 wherein the first coupling member for holding the telescope in the elongated semi-cylindrically shaped base support member is a pair of adjustment screws removably coupled in the apertures in the side of the base support member for lockingly engaging the telescope.

8. An adjustable mounting apparatus for supporting and holding a telescope in a predetermined position as defined in claim 7 wherein the second coupling member for holding the telescope in the elongated semi-cylindrically shaped base support member is a pair of adjustment screws removably coupled in the apertures in the other side of the elongated semi-cylindrically shaped base support member for lockingly engaging the telescope.

9. An adjustable mounting apparatus for supporting and holding a telescope in a predetermined position as defined in claim 8 wherein the first coupling member is an elastic band.

10. An adjustable mounting apparatus for supporting and holding a telescope in a predetermined position defined in claim 9 wherein the second coupling member is an elastic band.

* * * * *